US010549245B2

(12) United States Patent
Freudenberg et al.

(10) Patent No.: US 10,549,245 B2
(45) Date of Patent: Feb. 4, 2020

(54) APPARATUS AND METHOD FOR DISPENSING SOLUTIONS FROM SOLID PRODUCTS

(71) Applicant: Ecolab USA Inc., Saint Paul, MN (US)

(72) Inventors: Jared R. Freudenberg, Saint Louis Park, MN (US); Ryan Jacob Urban, Mahtomedi, MN (US); John David Morey, Saint Paul, MN (US)

(73) Assignee: Ecolab USA Inc., Saint Paul, MN (US)

( * ) Notice: Subject to any disclaimer, the term of this patent is extended or adjusted under 35 U.S.C. 154(b) by 1216 days.

(21) Appl. No.: 14/451,825

(22) Filed: Aug. 5, 2014

(65) Prior Publication Data

US 2016/0038889 A1 Feb. 11, 2016

(51) Int. Cl.

| | |
|---|---|
| ***B01F 1/00*** | (2006.01) |
| ***B01F 5/00*** | (2006.01) |
| ***B01F 15/02*** | (2006.01) |

(52) U.S. Cl.

CPC ..... *B01F 1/0038* (2013.01); *B01F 5/0065* (2013.01); *B01F 15/0203* (2013.01); *B01F 2215/004* (2013.01)

(58) Field of Classification Search

CPC ..... B01F 1/0027; C02F 1/688

See application file for complete search history.

(56) References Cited

U.S. PATENT DOCUMENTS

| | | | |
|---|---|---|---|
| 989,826 | A | 4/1911 | Thiele |
| 2,477,998 | A | 8/1949 | McCowan |
| 2,624,619 | A | 1/1953 | Fletcher et al. |
| 2,936,898 | A | 5/1960 | Miguez |

(Continued)

FOREIGN PATENT DOCUMENTS

| | | | |
|---|---|---|---|
| CN | 101421023 | A | 4/2009 |
| CN | 103338721 | A | 10/2013 |

(Continued)

OTHER PUBLICATIONS

International Patent Application No. PCT/US2015/042977, International Search Report & Written Opinion dated Oct. 20, 2015, 9 pages.

(Continued)

*Primary Examiner* — Tony G Soohoo

*Assistant Examiner* — Elizabeth Insler

(74) *Attorney, Agent, or Firm* — Fredrikson & Byron, P.A.

(57) ABSTRACT

An apparatus and method for creating and dispensing a solution formed of a solid product which is eroded or dissolved in a liquid, which may include methods for creating turbulent flow of the liquid. The apparatus includes an inlet portion for introducing the liquid into the dispenser system, a solution forming assembly, and an outlet portion for dispensing the solution. The solution forming assembly may include a support structure configured to support the solid product, and a reservoir coupled to the support structure, the reservoir configured to hold the liquid and allow flow of the liquid into and out of the reservoir, the reservoir including a base and one or more sidewall portions. The reservoir further including one or more liquid inlets located in the one or more sidewall portions configured to introduce liquid into the reservoir to contact the solid product and create the solution.

18 Claims, 7 Drawing Sheets

(56) References Cited

U.S. PATENT DOCUMENTS

| | | | | |
|---|---|---|---|---|
| 3,444,566 | A | | 5/1969 | Spear |
| 4,199,001 | A | | 4/1980 | Kratz |
| 4,347,224 | A | | 8/1982 | Beckert et al. |
| 4,420,394 | A | | 12/1983 | Lewis |
| 4,438,534 | A | | 3/1984 | Keyes et al. |
| 4,595,520 | A | | 6/1986 | Heile et al. |
| 4,680,134 | A | | 7/1987 | Heile et al. |
| 4,729,880 | A | | 3/1988 | Dirksing et al. |
| 4,732,689 | A | | 3/1988 | Harvey et al. |
| RE32,763 | E | | 10/1988 | Fernholtz et al. |
| 4,777,670 | A | | 10/1988 | Klinkhammer et al. |
| RE32,818 | E | | 1/1989 | Fernholz et al. |
| 4,898,202 | A | | 2/1990 | Craig |
| 4,909,387 | A | | 3/1990 | Schutz |
| 4,947,988 | A | | 8/1990 | Schutz |
| 4,957,134 | A | | 9/1990 | Craig |
| 5,007,559 | A | | 4/1991 | Young |
| 5,192,431 | A | | 3/1993 | Holmes |
| 5,194,230 | A | | 3/1993 | Pekarna et al. |
| 5,262,132 | A | | 11/1993 | Bricker et al. |
| 5,316,688 | A | | 5/1994 | Gladfelter et al. |
| 5,374,119 | A | * | 12/1994 | Scheimann ..... B01F 1/00 137/268 |
| 5,379,813 | A | | 1/1995 | Ing |
| 5,384,102 | A | * | 1/1995 | Ferguson ..... B01F 1/0033 137/268 |
| 5,389,344 | A | | 2/1995 | Copeland et al. |
| 5,441,711 | A | * | 8/1995 | Drewery ..... B01F 1/0033 137/268 |
| 5,494,644 | A | | 2/1996 | Thomas et al. |
| 5,580,448 | A | | 12/1996 | Brandreth, III |
| 5,678,688 | A | | 10/1997 | Schuetz |
| 5,782,109 | A | | 7/1998 | Spriggs et al. |
| 5,810,999 | A | | 9/1998 | Bachand et al. |
| 5,927,610 | A | | 7/1999 | Dutcher |
| 5,932,093 | A | | 8/1999 | Chulick |
| 6,164,042 | A | | 12/2000 | Tobolka |
| 6,177,392 | B1 | | 1/2001 | Lentsch et al. |
| 6,247,189 | B1 | | 6/2001 | Dean et al. |
| 6,267,886 | B1 | | 7/2001 | Brandreth |
| 6,280,617 | B1 | | 8/2001 | Brandreth |
| 6,287,466 | B1 | | 9/2001 | Yassin |
| 6,395,172 | B1 | | 5/2002 | Koike |
| 6,444,174 | B1 | | 9/2002 | Lascombes |
| 6,484,953 | B2 | | 11/2002 | Freier |
| 6,662,380 | B1 | | 12/2003 | Leonard et al. |
| 6,773,668 | B1 | | 8/2004 | Everson et al. |
| 6,855,252 | B2 | | 2/2005 | Brandreth, III |
| 7,069,602 | B1 | | 7/2006 | Conway et al. |
| 7,143,898 | B1 | | 12/2006 | Hoaglin |
| 7,250,086 | B2 | | 7/2007 | Furber et al. |
| 7,490,783 | B2 | | 2/2009 | Mueller et al. |
| 7,597,861 | B2 | | 10/2009 | Thomas et al. |
| 7,658,844 | B2 | | 2/2010 | Blanchette |
| 7,934,403 | B2 | | 5/2011 | Cho et al. |
| 8,075,847 | B2 | | 12/2011 | Zettlitzer et al. |
| 8,079,770 | B2 | | 12/2011 | Widmer et al. |
| 8,172,109 | B2 | | 5/2012 | Cadden |
| 8,230,777 | B2 | | 7/2012 | Anson et al. |
| 8,777,037 | B2 | | 7/2014 | Knopow et al. |
| 8,889,048 | B2 | | 11/2014 | Stolte et al. |
| 9,403,131 | B2 | | 8/2016 | Hedlund et al. |
| 9,533,331 | B1 | | 1/2017 | Kane et al. |
| 9,662,618 | B2 | | 5/2017 | Snodgrass et al. |
| 9,850,060 | B2 | | 12/2017 | Freudenberg et al. |
| 10,118,137 | B2 | | 11/2018 | Schwartz et al. |
| 2002/0030004 | A1 | | 3/2002 | Hammonds |
| 2002/0084228 | A1 | | 7/2002 | Sweeny et al. |
| 2003/0205286 | A1 | | 11/2003 | Hennemann, Jr. et al. |
| 2005/0077370 | A1 | | 4/2005 | Decker et al. |
| 2005/0121058 | A1 | | 6/2005 | Furber et al. |
| 2005/0167448 | A1 | | 8/2005 | Schall et al. |
| 2005/0244315 | A1 | | 11/2005 | Greaves et al. |
| 2006/0097076 | A1 | | 5/2006 | Mueller et al. |
| 2006/0108455 | A1 | | 5/2006 | Thornton |
| 2006/0133070 | A1 | | 6/2006 | Brown |
| 2006/0191833 | A1 | | 8/2006 | Greene et al. |
| 2006/0249183 | A1 | | 11/2006 | Kon et al. |
| 2007/0214555 | A1 | | 9/2007 | Ferrara et al. |
| 2008/0296214 | A1 | | 12/2008 | Blanchette |
| 2010/0059421 | A1 | | 3/2010 | Reed et al. |
| 2010/0239476 | A1 | | 9/2010 | King et al. |
| 2011/0165034 | A1 | | 7/2011 | Carlson et al. |
| 2011/0210139 | A1 | | 9/2011 | Limback et al. |
| 2012/0001776 | A1 | | 1/2012 | Yu et al. |
| 2012/0152813 | A1 | | 6/2012 | Stafford |
| 2012/0241045 | A1 | | 9/2012 | Aouad |
| 2012/0273585 | A1 | | 11/2012 | Broome |
| 2012/0320706 | A1 | | 12/2012 | Sanville et al. |
| 2013/0215705 | A1 | | 8/2013 | Mueller |
| 2013/0216450 | A1 | | 8/2013 | Carroll et al. |
| 2014/0056097 | A1 | | 2/2014 | Sanville et al. |
| 2014/0233346 | A1 | | 8/2014 | Schultz |
| 2014/0263404 | A1 | | 9/2014 | Snodgrass et al. |
| 2014/0271399 | A1 | | 9/2014 | Hedlund et al. |
| 2017/0052051 | A1 | | 2/2017 | Emmert |

FOREIGN PATENT DOCUMENTS

| | | | |
|---|---|---|---|
| EP | 0058507 | A1 | 8/1982 |
| EP | 413373 | B1 | 3/1993 |
| EP | 659956 | A1 | 6/1995 |
| EP | 1289890 | A1 | 3/2003 |
| EP | 2125250 | B1 | 11/2011 |
| FR | 2764821 | B1 | 8/1999 |
| JP | S61114720 | A | 6/1986 |
| JP | 03084130 | A | 4/1991 |
| JP | H09508579 | A | 9/1997 |
| JP | 2005530602 | A | 10/2005 |
| JP | 2009-543677 | A | 12/2009 |
| JP | 2010167399 | A | 8/2010 |
| JP | 2010528836 | A | 8/2010 |
| JP | 2012157736 | A | 8/2012 |
| WO | 9931018 | A1 | 6/1999 |
| WO | 2008037869 | A1 | 4/2008 |
| WO | 2014033689 | A2 | 3/2014 |

OTHER PUBLICATIONS

U.S. Appl. No. 14/061,817, entitled "Single Piece Three-Way Elastomeric Valve," filed Oct. 24, 2013, 27 pages.

European Patent Application No. 15830414.7, Partial Supplementary European Search Report dated Feb. 23, 2018, 15 pages.

EP Patent Application No. 15830414.7, Extended European Search Report and Written Opinion dated Jul. 13, 2018, 13 pages.

Partial Machine Translation of Publication FR 2764821, Aug. 27, 1999, 6 pages.

"POK Rambojet Quick Stick Foam Nozzle," Fire Safety USA, Retrieved from <https://firesafetyusa.com/item.aspx/15207-quick-stick-foam-nozzle/> Dec. 14, 2017, 6 pages.

* cited by examiner

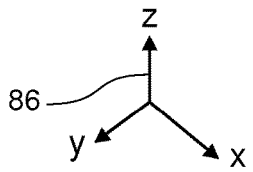
*Fig. 1c*
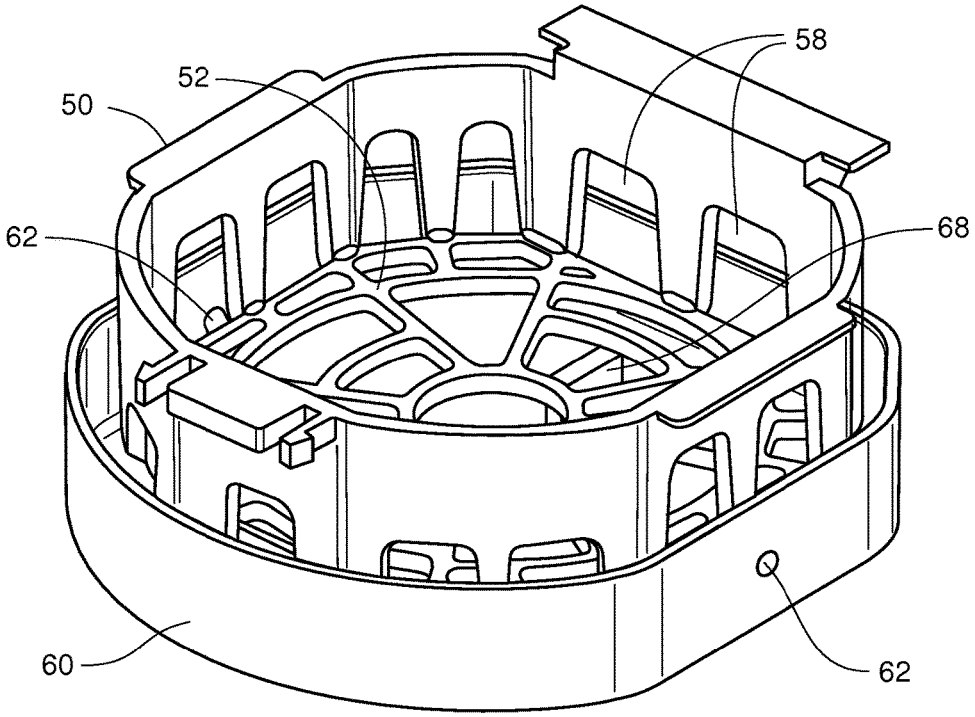

APPARATUS AND METHOD FOR DISPENSING SOLUTIONS FROM SOLID PRODUCTS

BACKGROUND

Solutions formed from dissolving a solid product in a liquid are known and have been utilized in various applications. Accordingly, solution-forming devices have been developed in order to create desired solutions without the need to manually create them. A liquid is supplied to the device to erode or dissolve a solid product, the solution is formed therein and then flows out of the device. Such devices may be used to create cleaning and sanitizing solutions or other desired solutions.

Dissolution parameters of a solid product into a liquid to create a liquid solution, such as a liquid detergent used for cleaning and sanitizing, change based on the flow characteristics of the liquid when it is in contact with the solid product.

SUMMARY

Embodiments of the present invention relate to methods and apparatuses for the formation of a solution between a solid product (e.g., solid block of chemistry) and a liquid (e.g., fluid) in contact with the solid product. More particularly, but not exclusively, the present invention relates to methods and apparatuses for providing liquid flow, including turbulent liquid flow, to erode or dissolve the solid product(s).

An exemplary embodiment of the dispenser system for creating a solution by dissolving a solid product in a liquid may include a housing, an inlet portion for introducing the liquid into the dispenser system, a solution forming assembly that may be at least partially within the housing, and an outlet portion for dispensing the solution. The solution forming assembly may include a support structure configured to support the solid product, and a reservoir operatively coupled to the support structure. The reservoir may be configured to hold the liquid and allow flow of the liquid into the reservoir. The flow of the liquid may be via the inlet portion and into the reservoir, and the resulting solution may flow out of the reservoir. The reservoir may include a base portion, one or more sidewall portions extending away from the base portion to retain the liquid within the reservoir, and one or more liquid inlets located in the one or more sidewall portions configured to introduce the liquid into the reservoir via the inlet portion. The reservoir may be positioned proximate the support structure such that the liquid contacts the solid product when the liquid is held in the reservoir to create the solution to be dispensed via the outlet portion.

An exemplary embodiment of a method for creating a solution by dissolving a solid product in a liquid may include providing a dispenser system including a housing, an inlet portion for introducing the liquid into the dispenser system, a solution forming assembly being at least partially within the housing, and an outlet portion for dispensing the formed solution. The solution forming assembly may include a support structure configured to support the solid product, a reservoir operatively coupled to the support structure, the reservoir configured to hold the liquid and allow flow of the liquid into the reservoir via the inlet portion, and the solution then flows out of the reservoir. The reservoir may include a base portion, one or more sidewall portions extending away from the base portion to retain the liquid within the reservoir, and one or more liquid inlets located in the one or more sidewall portions configured to introduce the liquid into the reservoir via the inlet portion. The reservoir may be positioned proximate the support structure such that the liquid contacts the solid product when the liquid is held in the reservoir to create the solution. The method further includes introducing the liquid into the reservoir to dissolve the solid product in the liquid to create a solution, and then dispensing the solution via the outlet portion.

Apparatuses for and methods of dispensing a solution formed from dissolving a solid product within a liquid fluid fall within the scope of the present invention. The details of one or more examples and embodiments of the invention are set forth in the accompanying drawings and the description below. Other features, objects, and advantages will be apparent from the description and the drawings, as well as from the claims of the invention.

BRIEF DESCRIPTION OF THE DRAWINGS

FIG. 1*c* depicts a perspective view of portions of the solution forming assembly and dispenser system of FIG. 1*a*, as assembled.

DETAILED DESCRIPTION

The present invention is aimed at creating easy-to-use, cost-effective and repeatable solutions. Embodiments of the invention are designed to dispense a solution formed from a solid product and an incident liquid such as water. The solid product may comprise many different products, including but not limited to a sanitizer, a detergent, or a floor care product, as many applications of the present invention may involve creating a solution for a cleaning process. In many cases, it is desirable to erode the solid product evenly and consistently to achieve and maintain a certain concentration of a solution for cost, performance, or even regulatory reasons.

Figure 1A:
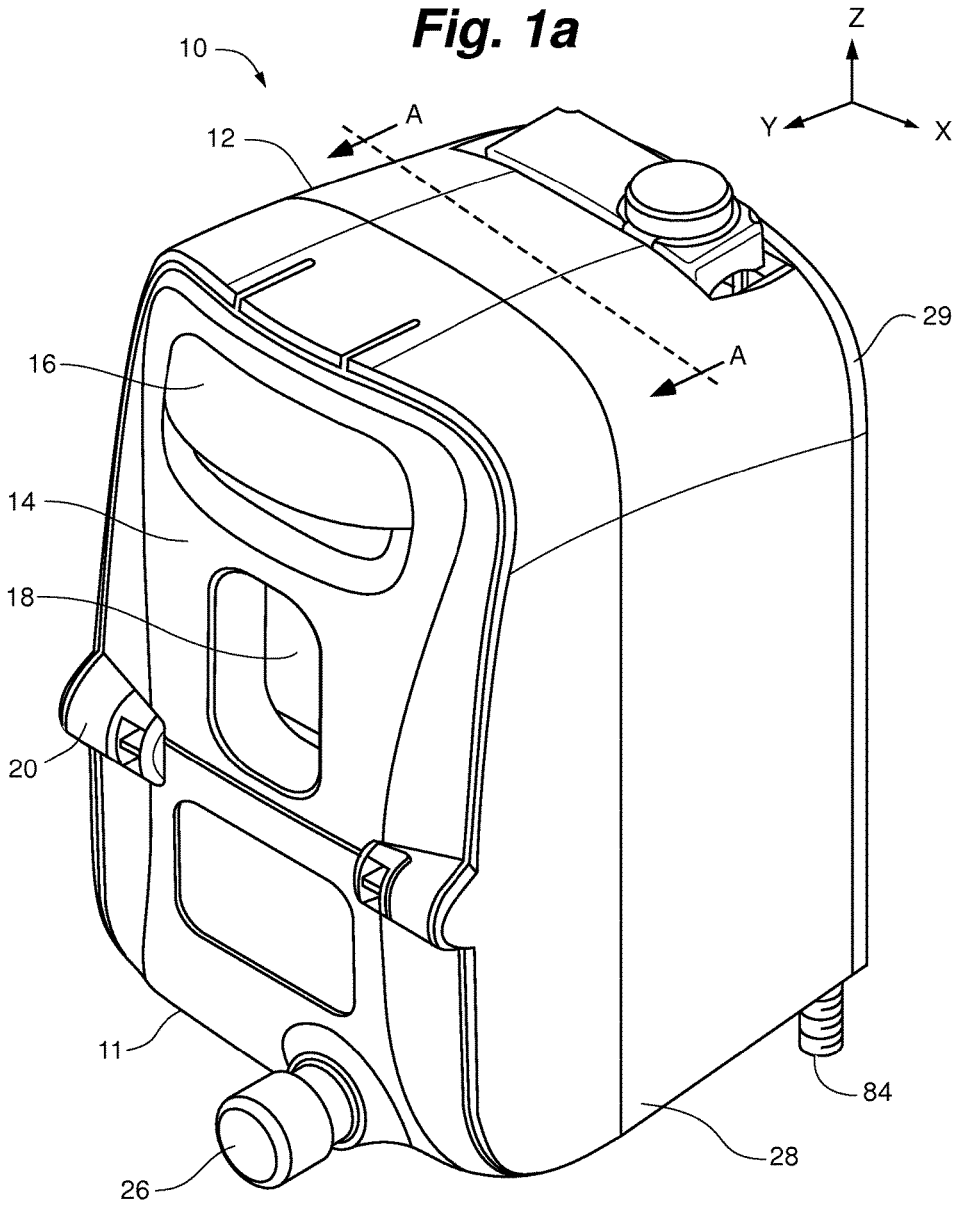
FIG. 1*a* depicts a perspective view of one illustrative embodiment of a dispenser system described herein.

FIG. 1*a* shows an exemplary embodiment of a dispenser system 10 for use with the present invention. However, it should be noted that other types and configurations of dispensers may be used with the invention, and the description and figures of the dispenser system 10 are not to be limiting. The dispenser system 10 is configured to hold a solid product that is combined with a liquid, such as water, to create a solution. For example, the solid product may be mixed with the liquid (e.g., fluid) to create a cleaning detergent. The dispenser system works by having the liquid interact with the solid product to form a solution having a desired concentration for its end use application. The liquid may be introduced to a bottom, side, or other suitable surface of the solid product, as will be discussed below.

The dispenser system 10 of the present disclosure includes features that result in novel flow schemes (e.g., patterns) of the liquid. The novel flow schemes include creating turbulent flow patterns of the liquid within the dispenser system 10, and in particular, within a reservoir 60 of a solution forming assembly 30 of the dispenser system 10 (the reservoir 60 and solution forming assembly 30 are inside the housing 12 and are cannot be seen in FIG. 1*a*, see FIGS. 1*b* and 1*d*). The turbulent liquid flow interacts with the solid product in the reservoir 60 of the dispenser system 10 to create the solution. Features of the present disclosure provide more control over how the solid product dissolves into the liquid. Liquid flow patterns described herein affect how the solid product dissolves into the liquid. The present disclosure may be used to provide more consistent and more repeatable erosion patterns and solutions while also providing increased flexibility with regard to the dispenser system geometry and the concentration of the solution dispensed. In addition, unlike conventional dispenser systems using spray nozzles, the dispenser system 10 is not limited by available spray nozzle technology and patterns.

According to the exemplary embodiment, the dispenser system 10 of FIG. 1 includes a housing 12 comprising a front door 14 having a handle 16 thereon. The front door 14 may be hingeably connected to a front fascia 11 via hinges 20 therebetween. This allows the front door 14 to be rotated about the hinge 20 to allow access into the housing 12 of the dispenser system 10. For example, the front door 14 includes a window 18 therein to allow an operator to view the solid product housed within the housing 12. Once the housed product has been viewed to erode to a certain extent, the front door 14 can be opened via the handle 16 to allow an operator to replace the solid product with a new un-eroded product.

Mounted to the front fascia 11 is a button 26 for activating the dispenser system 10. The button 26 may be a spring-loaded button such that pressing or depressing of the button 26 activates the dispenser system 10 to discharge an amount of solution created by the solid product and the liquid. Thus, the button 26 may be preprogrammed to dispense a desired amount per pressing of the button, or may continue to discharge an amount of solution while the button 26 is depressed.

Connected to the front fascia 11 is a rear enclosure 28, which generally covers the top, sides and rear of the dispenser system 10. The rear enclosure 28 may also be removed to access the interior of the dispenser system 10. A mounting plate 29 may be positioned at the rear of the dispenser system 10 and includes features for mounting the dispenser system 10 to a wall or other structure, if desired. For example, the dispenser system 10 may be attached to a wall via screws, hooks, or any other suitable mounting device. The components of the housing 12 of the dispenser system 10 may be molded plastic, metal, a combination of materials, or any other suitable material.

Figure 1B:
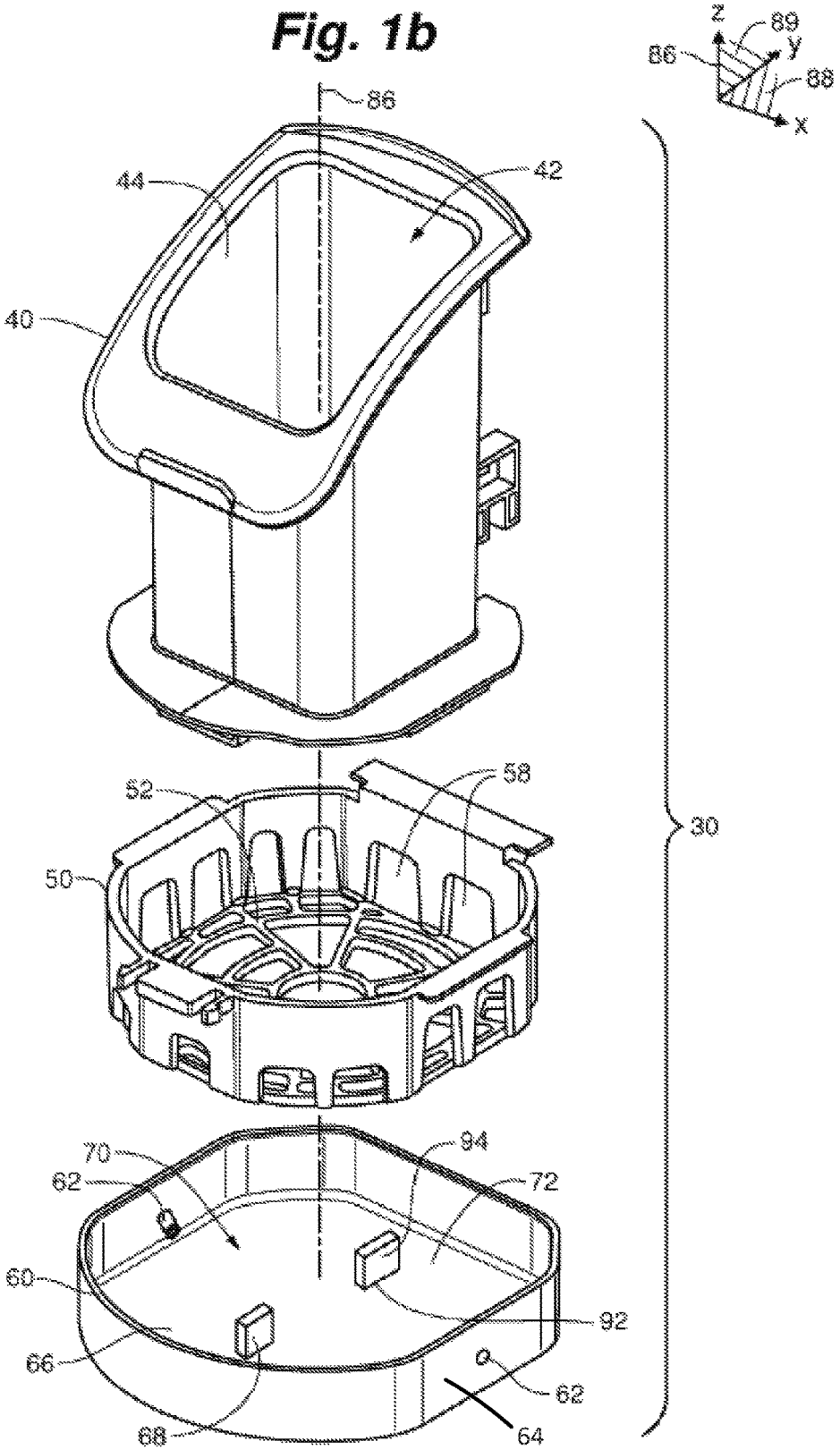
FIG. 1*b* depicts an exploded assembly view of one illustrative embodiment of a solution forming assembly of the dispenser system of FIG. 1*a*.

As shown in FIG. 1*b*, the dispenser system 10 includes solution forming assembly 30. FIG. 1*b* depicts an exploded assembly view of the solution forming assembly 30, including a solid product guide 40 for holding the solid product to be dissolved, a solid product support structure 50 (referred to herein as support structure 50) for supporting the solid product while allowing the solid product to interact with the liquid in the reservoir 60, which holds the liquid to form the solution.

FIG. 1*c* is a perspective view of the support structure 50 and the reservoir 60 of the solution forming assembly 30 of FIGS. 1*a-b*, in their assembled state, as they may be positioned relative to one another. With regard to FIGS. 1*b*-1*d*, a solid product to be dissolved may be placed within a cavity 42 of the solid product guide 40 including walls 44 which may guide and/or surround all or a portion of the solid product to be dissolved, into place within housing 12. The solid product is placed on the support structure 50, which as depicted, may be grate 52. The support structure 50 may be in the form of a molded plastic component, but may also include interlocking wires, a metal stamped or casted component, ceramics, a combination of such materials, or any other suitable support structure that is configured to support the solid product in contact with the liquid to form a solution. The support structure 50 may be a component separate from the solid product guide 40 and the reservoir 60, or the features may be integrated into one or more adjacent components of the dispenser system 10.

A liquid, such as water or any other suitable fluid, is connected to the dispenser system 10 via an inlet portion 84. As shown in FIG. 1*a*, the inlet portion 84 (FIG. 1*a*) is connected to the button 26 such that pressing the button 26 will pass liquid into the dispenser system 10 to come in contact with the solid product. For example, the liquid may pass from the inlet portion 84 into the reservoir 60 (FIGS. 1*b-e*) via one or more liquid inlets 62 formed in one or more sidewall portions 64 of the reservoir 60. The liquid may be routed from the inlet portion 84 to the one or more liquid inlets 62 via one or more tubes. The tubes connecting the inlet portion 84 and the liquid inlets 62 are not depicted, but are conventional in the art and would be known to one of ordinary skill in the art.

FIGS. 1*b*-1*e* depicts an exemplary embodiment of the reservoir 60 for forming the solution. The reservoir 60 is formed by the sidewall portions 64 and base portion 66 such that the reservoir 60 is configured to contain liquid. The sidewall portions 64 may extend upward and away from the base portion 66 at an angle (e.g., an angle greater than 0 degrees, generally extending upward at around 90 degrees). Sidewall portions 64 have an internal surface facing the inside of the reservoir 60 and an opposite external surface facing out of the reservoir 60. The sidewall portions 64 may define the perimeter of the reservoir 60. The internal perimeter of the reservoir 60 may be further defined as the internal surface of the sidewall portions 64 (e.g., surfaces facing the internal cavity 70) of the reservoir 60. The internal cavity 70 of the reservoir 60 may be defined by the first surface 72 of the base portion 66 and the internal perimeter of the sidewall portions 64.

The solution is formed when a portion or portions of the solid product adjacent to (e.g., supported by) the support structure 50 comes into contact with the liquid (e.g., fluid flow) in the reservoir 60. For example, the geometric relationship of the support structure 50 and the reservoir 60 may be such that the support structure 50 extends into the internal cavity 70 of the reservoir 60 while a gap, space or volume is maintained between the base portion 66 of the reservoir 60 and the support structure 50. The mixing of the liquid and solid product erodes the solid product, which dissolves portions of the solid product in the liquid to form a liquid solution within the reservoir 60. The solution continues to rise in the reservoir 60 until it reaches the level of one or more overflow ports 58, which may be determined by the height of the sidewall portions 64. However, the overflow ports 58 do not have to be defined by the geometry of the reservoir 60, but may be incorporated into other components of the dispenser system 10. For example, the overflow ports 58 may be formed by the reservoir 60 in combination with additional components such as the support structure 50. The solution passes through the overflow port(s) 58 and into the collection zone 80, which is depicted as a funnel in FIG. 1*d*, but may be any suitable collection zone 80. From the collection zone 80, the solution exits the dispenser system 10 at outlet portion 82. At this stage, the solution may be used in a desired application.

As depicted in FIGS. 1*b*-1*e*, the one or more liquid inlets 62 located in the one or more sidewall portions 64 may include one or more liquid inlets 62 that are angled or non-orthogonal with respect to the respective sidewall portion 64 that the liquid inlet 62 is located in. In other words, the liquid inlets 62 may be configured to provide liquid flow, or a portion of the liquid flow, that is non-orthogonal to the respective sidewall portion 64 (e.g., generally non-orthogonal, substantially non-orthogonal or initially non-orthogonal, or introduced non-orthogonal to the respective sidewall portion 64). Although some of the sidewall portions 64 are depicted in FIGS. 1*b*-1*e* as being generally planar at the liquid inlet, in a case where the sidewall portions 64 are not planar, but rather the surface of the sidewall portions 64 has some degree of curvature or irregularity, the liquid inlets 62 may be defined as being positioned in the sidewall portions such that the flow of the particular liquid inlet 62 is non-orthogonal to a plane tangent to the respective sidewall portion 64 at the respective liquid inlet 62.

Figure 1D:
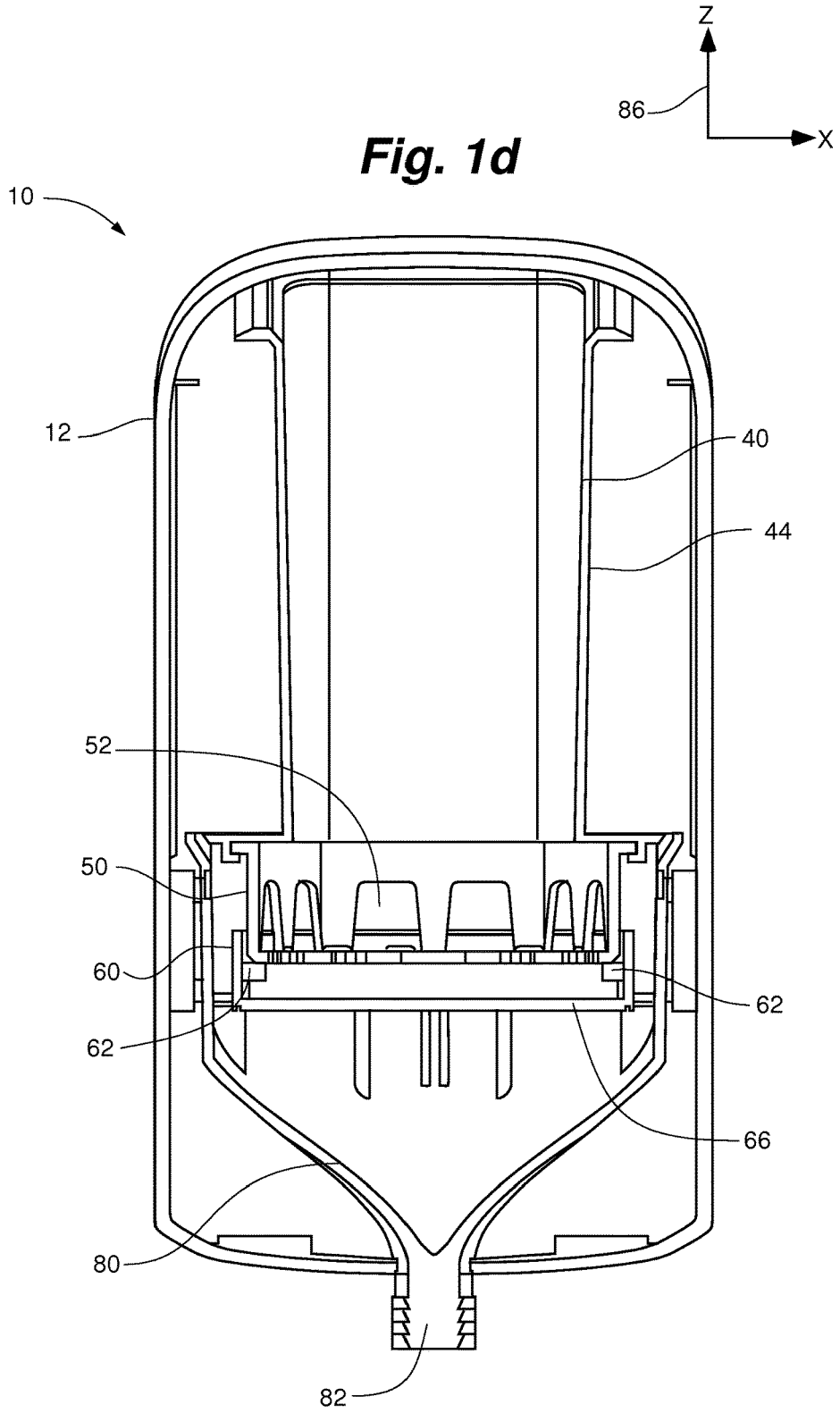
FIG. 1*d* depicts a cross-sectional view of the illustrative embodiment of FIG. 1*a*, taken at line A-A.
Figure 1E:
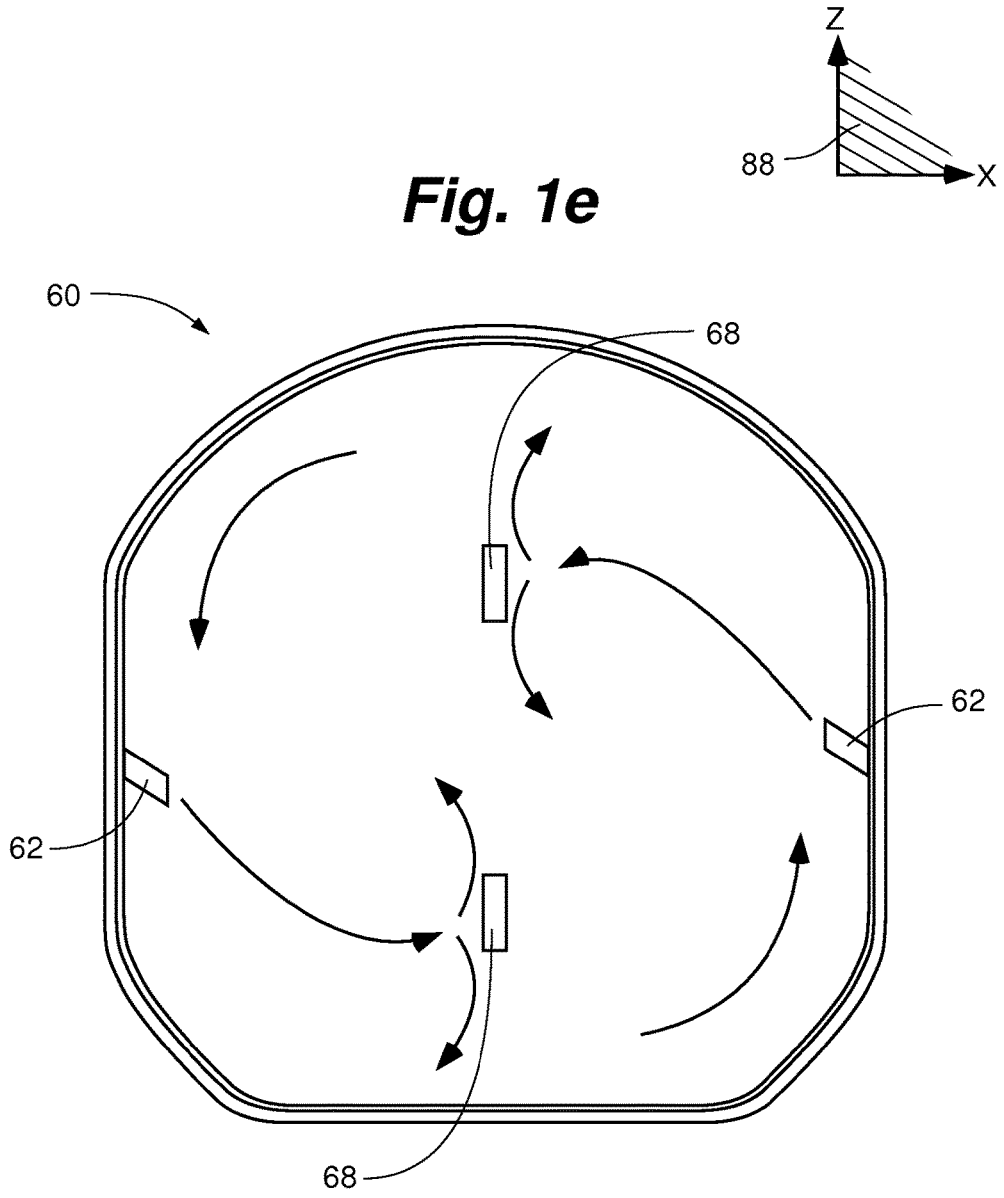
FIG. 1*e* depicts a top view of one illustrative embodiment of a reservoir of the solution forming assembly of the dispenser system of FIG. 1*a*, including one embodiment of a liquid flow pattern.

A potential liquid flow pattern of the exemplary embodiment of FIGS. 1*b*-1*e* is shown in FIG. 1*e*. As shown, the reservoir may be configured to create a circular flow pattern of the liquid in the reservoir when the liquid is introduced into the reservoir through the one or more liquid inlets 62. For example, the angled (e.g. non-orthogonal) liquid inlets 62, as depicted, contribute to a circular flow pattern (e.g., generally circular, substantially circular, including a portion having a circular flow pattern). This circular liquid flow pattern affects the level of turbulence in the reservoir 60 and the dissolving or erosion characteristics of the solid product. Characteristics affected by the liquid flow pattern in the solution forming assembly 30 may include: the erosion pattern, the dissolving rate, and the concentration of the final solution, etc.

In one or more embodiments, and as shown in the exemplary embodiment of FIG. 1*e*, at least one turbulence generating reaction surfaces 68 may be included and configured to increase the turbulence of the liquid flow in the reservoir 60 when liquid is introduced into the reservoir 60. The one or more turbulence generating reaction surfaces 68 are located within the internal perimeter or internal cavity 70 of the reservoir 60 and may be located centrally in the reservoir 60 relative to the perimeter of the reservoir 60. Though a circular flow pattern is not required to be used in combination with the one or more turbulence generating reaction surfaces 68, the reservoir 60 may be configured to create a circular flow pattern of the liquid in the reservoir 60 when the liquid is introduced into the reservoir 60 through the one or more liquid inlets 62, and the reservoir 60 may further include at least one turbulence generating reaction surface 68 that creates additional turbulence when the flow of liquid (e.g., circular flow of liquid, linear flow of liquid) comes into contact with the at least one turbulence generating reaction surface 68.

In some embodiments, at least one turbulence generating reaction surface 68 may be formed in the base portion 66 (e.g., molded with, attached to, coupled to, or adhered to base portion 66). The one or more turbulence generating reaction surfaces 68 may extend upwards from a first end portion 92 proximal to the base portion 66 to a second end portion 94 distal to the base portion 66.

The one or more turbulence generating reaction surfaces 68 may be placed directly or indirectly in the flow path of the liquid being introduced into the reservoir 60 via the liquid inlets 62. Locating the turbulence generating reaction surface 68 directly in the flow path of the respective liquid inlet 62 (e.g., immediate flow path of the liquid inlet, near the liquid inlet, opposite or opposing the liquid inlet) provides increased turbulence or agitation of the liquid flow. This increased turbulence may change the flow of liquid laterally within the reservoir 60 (e.g., parallel to the base portion 66), but may also induce motion upward towards the grate 52 and solid product. A portion of the flow may also move downwards towards the base portion 66. The one or more turbulence generating reaction surfaces 68 may generally create turbulent flow in any direction, deflecting and agitating the liquid flow to move in a direction different than the initial flow of liquid from a respective liquid inlet 62. Different geometric and location characteristics of the one or more turbulence generating reaction surfaces 68 result in different erosion and dissolving characteristics of the solid product. Variations in turbulence may also affect the concentration characteristics of the created solution.

The reservoir 60 may further include various other arrangements of the one or more turbulence generating reaction surfaces 68. The reservoir 60 may also include no turbulence generating reaction surfaces 68. Various embodiments of the turbulence generating reaction surfaces 68 may be incorporated into reservoir 60 depending on the characteristics of the solid product, the liquid used to dissolve the solid product, and the desired solution to be produced. In some embodiments, at least one of the one or more liquid inlets 62 may provide liquid flow to at least one turbulence generating surface 68 such that at least a portion of the liquid flow is provided as being substantially orthogonal or non-orthogonal to the at least one turbulence generating reaction surface 68, depending on the desired turbulence characteristics and the final solution to be created. In the case where the reaction surface is non-planar, it may be described that at least a portion of the liquid flow may be substantially orthogonal or non-orthogonal to a plane tangent to at least one turbulence generating reaction surface 68, depending on the desired turbulence characteristics and the final solution to be created.

The one or more turbulence generating reaction surfaces 68 and the support structure 50 (e.g., grate 52) may be spaced apart along the axis of assembly 86 such that a gap 96 (as shown in the portions of components depicted FIG. 4) is maintained between any of the one or more turbulence generating reaction surfaces 68 and the support structure 50 (e.g., grate 52) along the axis of assembly 86 (axis shown in FIGS. 1*b*-1*d*). Maintaining gap 96 allows liquid to flow to occur in between an upper surface of the turbulence generating reaction surface 68 that faces the grate 52, and the surface of the grate 52 that faces the turbulence generating reaction surface 68. In some embodiments, however, at least one of the turbulence generating reaction surfaces 68 may not include gap 96 be in contact with the support structure 50, including grate 52.

Figure 4:
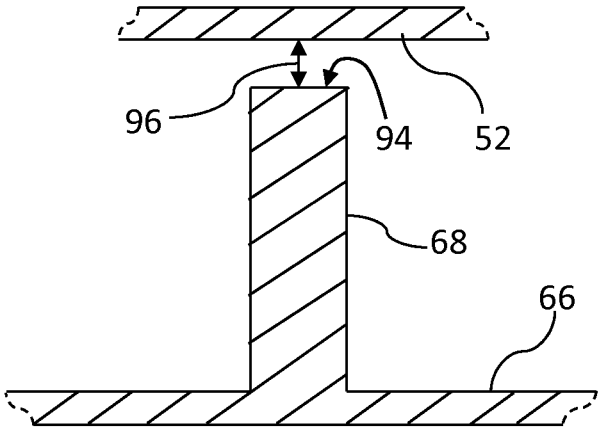
FIG. 4 depicts an embodiment of portions of a reservoir and support structure that could be used in the dispenser system of FIG. 1*a*, including a gap maintained between the reservoir and support structure.

In some alternate embodiments, the one or more turbulence generating reaction surfaces 68 may be formed or incorporated into another component other than the base portion 66. For example, the turbulence generating reaction surfaces 68 could be molded into the support structure 50 and extend downward, below the support structure 50 (e.g., grate 52) towards the base portion 66 of the reservoir 60. Such turbulence generating reaction surfaces 68 could contact the base portion 66, or the gap 96 (As shown in FIG. 4) may be maintained between all or a portion of any of the one or more turbulence generating reaction surfaces 68 and the base portion 66 (See, FIG. 4)

Some embodiments of the reservoir 60 include various arrangement of liquid inlets 62 and turbulence generating reaction surfaces 68 that provide different degrees of turbulence and erosion that can be tailored depending on the particular solid product, dissolving liquid, and desired characteristic of the solution to be dispensed. FIGS. 1*b-e* shows just one embodiment of the reservoir 60. Other embodiments depicting examples of other liquid inlet 62 and turbulence generating reaction surface 68 relationships which fall within the scope of this disclosure, are shown and described with respect to FIGS. 2 and 3.

Figure 2:
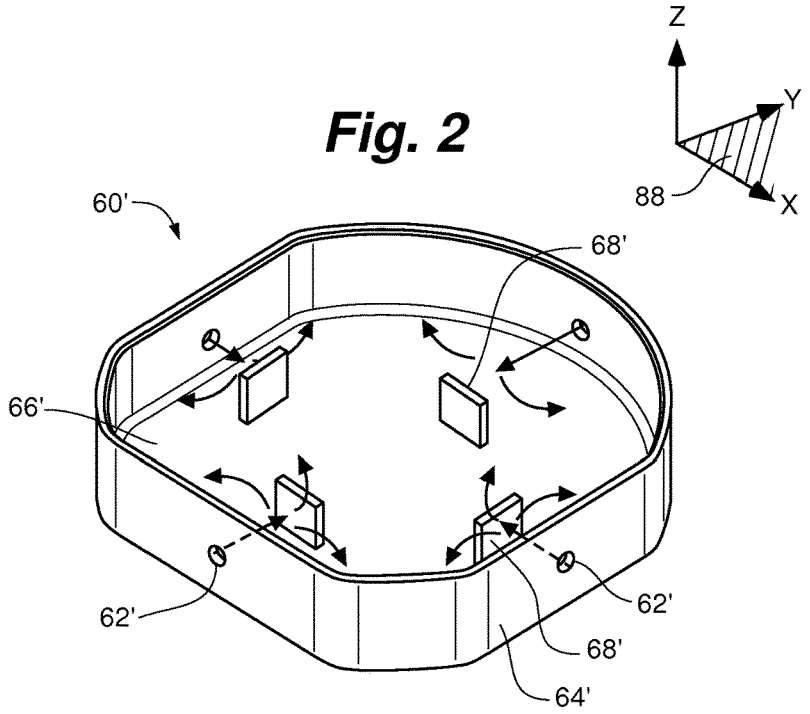
FIG. 2 depicts a perspective view of another embodiment of a reservoir that could be used in the dispenser system of FIG. 1*a*, including one embodiment of a liquid flow pattern.
Figure 3:
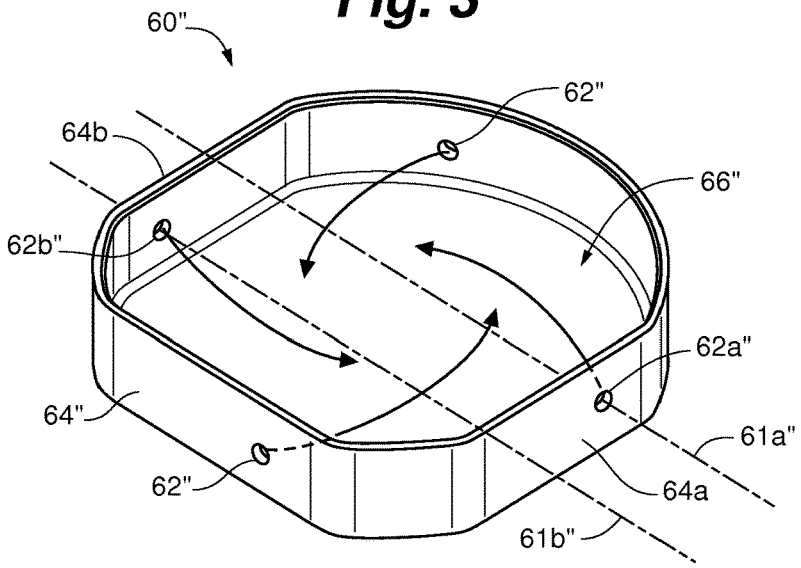
FIG. 3 depicts a perspective view of another embodiment of a reservoir that could be used in the dispenser system of FIG. 1*a*, including one embodiment of a liquid flow pattern.

FIGS. 2 and 3 depict other embodiments of the reservoir 60 that may provide circular flow and/or turbulent flow. Reservoir 60' is depicted in FIG. 2 and reservoir 60" is depicted in FIG. 3 which will now be discussed in further detail. It should be understood, unless described or stated otherwise, that components having like numbers also have similar characteristics as to those described with regard to the embodiment of FIGS. 1*a*-1*e*. For example, but not limited to, sidewall portions 64 are substantially similar to sidewall portions 64', 64"; base portion 66 is substantially similar to base portion 66', 66", etc. Any of the reservoir (60, 60', 60") embodiments, or variations of such embodiments described herein may be used within the dispenser system 10 of FIGS. 1*a-e*.

In one or more embodiments, and as depicted in FIG. 2, the liquid flow into reservoir 60' via at least one of the one or more liquid inlets 62' may be arranged orthogonal to the respective sidewall portion 64'. In other words, the liquid inlets 62' may be configured to provide liquid flow, or a portion of the liquid flow, that is orthogonal to the sidewall portion 64' (e.g., generally orthogonal, substantially orthogonal or initially orthogonal, or introduced orthogonal to the respective sidewall portion 64'). Although some of the sidewall portions 64' are depicted in FIG. 2 as being generally planar at the liquid inlet, in a case where the sidewall portions 64' are not planar, but rather the surface of the sidewall portions 64' has some degree of curvature or irregularity, the liquid inlets 62' may be defined as being positioned in the sidewall portions 64' such that the flow of the particular liquid inlet 62' is orthogonal to a plane tangent to the respective sidewall portion 64' at the respective liquid inlet 62'. This opposing arrangement of the liquid inlets 62' supports a turbulent liquid flow.

Increased turbulence may also be provided by including turbulence generating reaction surfaces 68' in the path of the liquid flow being introduced into the reservoir 60' by the liquid inlets 62'. The turbulence or turbulent change in flow path that is created at the turbulence generating reaction surfaces 68' may be in all directions, including laterally, parallel to the base portion 66', but also upwards towards the grate 52 and the solid product to be eroded, and downwards towards the base portion 66', or in any other direction. The upward and/or turbulent liquid flow induced, at least in part by the turbulence generating reaction surfaces 68' may result in more aggressive, faster, consistent, and evenly distributed erosion of the solid product. Features of the turbulent flow described with respect to FIG. 2 may also be present in other embodiments discussed herein.

In one or more embodiments, and as depicted in FIG. 3, the liquid into reservoir 60" via at least one of the one or more liquid inlets 62" in a first sidewall portion 64" may be arranged offset from at least one of the one or more liquid inlets 62" located on an opposite or opposing sidewall portion 64" of reservoir 60. In other words, the liquid flow from a first liquid inlet 62*a*" located in a first sidewall portion 64*a*" may be directly opposing the liquid flow from a second liquid inlet 62*b*" located in a second sidewall portion 64*b*". As shown in the embodiment of FIG. 3, and in contrast to the embodiment of FIG. 2, circular and/or turbulent flow may be provided in the absence of any turbulence generating reaction surfaces 68. Also in contrast to the embodiment of FIG. 2, a first central axis 61*a*" of the first liquid inlet 62*a*" may not be the same as, or coincide with a second central axis 61*b*" of the second liquid inlet 62*b*". In some embodiments the first central axis 61*a*" of the first liquid inlet 62*a*" may be parallel and spaced apart from the second central axis 61*b*" of the second liquid inlet 62*b*".

The reservoir 60" of FIG. 3 thus depicts offset liquid inlets 62". In the embodiments of reservoir 60, 60', discussed with respect to FIGS. 1*e* and 2, a central axis of any of the liquid inlets 62, 62' may be defined for each liquid inlet 62, 62'. However, in the embodiments of FIGS. 1*e* and 2, such a central axis may coincide with the central axis of another liquid inlet 62, 62' on an opposing sidewall 64. In other words, liquid inlets 62, 62' on opposing sidewall portions 64 may be aligned.

It is contemplated that embodiments not necessarily shown in the figures, but covered by the scope of this disclosure, may include various geometric arrangements, or combinations of such arrangements of liquid inlets 62, 62', 62" that would be considered either offset from or aligned with opposing liquid inlets 62, 62', 62". The liquid inlets 62, 62', 62" may be offset from or aligned with each other within a horizontal or reservoir plane 88, but may also be offset from or aligned with one another within a vertical plane 89 that is parallel to the axis of assembly 86 (assembly axis). The coordinate system including axes and planes described herein are depicted in at least FIG. 1*b*. Any arrangement of the liquid inlets 62, 62', 62", such that the liquid flow in the reservoir 60, 60" is configured to move in a circular pattern or have increase turbulence due to the placement of the liquid inlets 62, 62'. 62" including the characteristics described herein would be considered to fall within the scope of this disclosure.

The circular pattern of the liquid described in the reservoirs 60, 60", and variations of embodiments thereof, may be generally circular, substantially circular, mostly circular, primarily circular, initiated as circular, or at least a portion is circular. The circular pattern of liquid flow may be in a reservoir plane 88 that is perpendicular, or substantially perpendicular to the longitudinal or assembly axis 86 of the dispenser system 10 (coordinate system shown in at least FIG. 1*b*).

The liquid flow pattern in the reservoir 60, 60', 60" may also include components of liquid flow that are directed upwards toward the support structure 50, or downwards towards the base portion 66, 66', 66". The variations described herein, but not specifically depicted in the figures, and combinations of the variations described, are considered to within the scope and spirit of this disclosure.

An exemplary method for creating a solution by dissolving a solid product in a liquid using the dispenser system 10 (e.g., as shown in FIGS. 1*a-e*, 2 and 3) may include:

providing a dispenser system 10 including a housing 12, a solution forming assembly 30 and an outlet portion 82 for dispensing the solution. The provided solution forming assembly 30 shown in FIG. 1*b*, including a solid product guide 40, support structure 50 that are configured to support the solid product within the housing; a reservoir 60 configured to hold the liquid coupled to the solid product guide 40 and support structure 50 such that the solid product may be in contact with liquid in the reservoir 60, 60' or 60" (herein after referred to as 60) and allow flow of the liquid into and out of the reservoir 60. The reservoir 60 including a base portion 66 having a first surface 72 facing upward towards the solid product guide 40, one or more sidewall portions 64 extending away from the base portion 66 to retain the liquid within the reservoir 60, and one or more liquid inlets 62 located in the one or more sidewall portions 64 configured to introduce the liquid into the reservoir 60 to contact the solid product and create the solution.

The exemplary method further including introducing the liquid into the reservoir 60 to dissolve the solid product in the liquid to create a solution, and dispensing the solution via the outlet portion 82

In some embodiments, the method further includes the step of introducing the liquid into the reservoir 60 including introducing the liquid into the reservoir 60 such that a circular flow pattern of the liquid is created.

In some embodiments, the method further includes providing a reservoir 60 including at least one turbulence generating reaction surface 68 located within the reservoir 60, and the step of introducing the liquid into the reservoir 60 includes introducing the liquid into the reservoir 60 such that the liquid comes into contact with at least one turbulence generating reaction surface 68 located within the reservoir 60.

The methods described above may induce a turbulent flow pattern within the reservoir 60 and may include any and all the aspects of liquid flow described with regard to the dispenser system 10 described herein. All features described with respect to the dispenser system 10 apparatus may be incorporated into the method of using the dispenser system 10 to create a solution. The methods described herein are applicable to any of the reservoir 60, 60', 60" embodiments described herein and any variations falling within the scope of the reservoirs 60, 60', 60' described herein.

Various embodiments of the invention have been described. It should be known that the embodiments described herein are exemplary in nature and in no way limit the scope of the invention. Rather, they serve as examples illustrating various features and embodiments thereof. These and other embodiments are within the scope of the following claims.

The invention claimed is:

1. A dispenser system for creating a solution by dissolving a solid product in a liquid, the dispenser system comprising:
- a housing;
- an inlet portion for introducing the liquid into the dispenser system;
- a solution forming assembly being at least partially within the housing and including:
  - a support structure configured to support the solid product, the support structure including:
    - a grate at a base of the support structure, and
    - one or more overflow ports defined at the support structure, the one or more overflow ports extending from a first location at the grate at the base of the support structure to a second location spaced apart from the grate at the base of the support structure in a direction parallel to an axis of assembly;
  - a reservoir operatively coupled to the support structure, the reservoir configured to hold the liquid and allow flow of the liquid into the reservoir, via the inlet portion, and the solution out of the reservoir, the reservoir including:
    - a base portion,
    - one or more sidewall portions extending away from the base portion to retain the liquid within the reservoir, the one or more sidewall portions defining an internal perimeter of the reservoir,
    - a first liquid inlet and a second liquid inlet, the first liquid inlet located at a first location in the one or more sidewall portions and the second liquid inlet located at a second, different location in the one or more sidewall portions that is spaced apart about the internal perimeter of the reservoir from the first location, each of the first liquid inlet and the second liquid inlet configured to introduce the liquid into the reservoir via the inlet portion, and
    - the reservoir being positioned proximate the support structure such that the liquid contacts the solid product when the liquid is held in the reservoir to create the solution;
    - a first turbulence generating reaction surface and a second turbulence generating reaction surface that is spaced from the first turbulence generating reaction surface by the internal cavity of the reservoir, the first turbulence generating reaction surface located in a flow path of the first liquid inlet and the second turbulence generating reaction surface located in a flow path of the second liquid inlet; and
- an outlet portion for dispensing the solution received from the reservoir via the one or more overflow ports.

2. The dispenser system according to claim 1, wherein the first and second liquid inlets are configured to introduce the liquid into the reservoir to create the circular flow pattern of the liquid in the reservoir.

3. The dispenser system of claim 1, wherein at least one of the first and second liquid inlets introduce liquid into the reservoir at an angle non-orthogonal to the respective sidewall portion, or non-orthogonal to a plane tangent to the respective sidewall portion at the respective liquid inlet.

4. The dispenser system according to claim 1, wherein the first turbulence generating reaction surface and the second turbulence generating reaction surface are configured to increase the turbulence of the liquid flow in the reservoir when liquid is introduced into the reservoir.

5. The dispenser system according to claim 4, wherein each of the first turbulence generating reaction surface and the second turbulence generating reaction surface extends from a first end portion proximal to the base, to a second end portion distal to the base.

6. The dispenser system according to claim 5, wherein the first end of each of the first turbulence generating reaction surface and the second turbulence generating reaction surface is attached to the base.

7. The dispenser system according to claim 4, wherein at least one of the first and second liquid inlets provides liquid flow to at least one of the first and second turbulence generating reaction surfaces such that at least a portion of the liquid flow is substantially orthogonal to the at least one of the first and second turbulence generating reaction surfaces, or substantially orthogonal to a plane tangent to the at least one of the first and second turbulence generating reaction surfaces.

8. The dispenser system according to claim 1, wherein each of the first turbulence generating reaction surface and the second turbulence generating reaction surface creates additional turbulence when the circular flow of liquid comes into contact with each of the first turbulence generating reaction surface and the second turbulence generating reaction surface.

9. The dispenser system of claim 1, wherein at least one of the first and second liquid inlets located in the one or more sidewall portions inject liquid into the reservoir at an angle substantially orthogonal to the respective sidewall portion at the respective liquid inlet, or substantially orthogonal to a plane tangent to the respective sidewall portion at the respective liquid inlet.

10. The dispenser system of claim 9, wherein each of the first turbulence generating surface and the second turbulence generating reaction surface is configured to increase the turbulence of the liquid flow in the reservoir when the liquid is introduced into the reservoir.

11. The dispenser system according to claim 10, wherein each of the first turbulence generating reaction surface and the second turbulence generating reaction surface extends from a first end portion proximal to the base, to a second end portion distal to the base.

12. The dispenser system according to claim 11, wherein the first end portion of each of the first turbulence generating reaction surface and the second turbulence generating reaction surface is attached to the base.

13. The dispenser system according to claim 1, wherein the support structure is configured to support the solid product within the reservoir and maintain a gap between the base of the reservoir and the solid product while allowing the liquid to pass through at least one opening in the grate at the base of the support structure.

14. The dispenser system according to claim 1, wherein the one or more sidewall portions extend upward and away from the base at an angle greater than 0 degrees.

15. The dispenser system according to claim 1, wherein the support structure extends into an internal cavity of the reservoir.

16. The dispenser system of claim 15, wherein the support structure extends into the internal cavity of the reservoir to a location between the first and second liquid inlets and an end of the one or more sidewall portions.

17. The dispenser system of claim 15, wherein the base portion of the reservoir has a width that is greater than a width of a portion of the support structure that extends into the internal cavity.

18. The dispenser system of claim 1, wherein the overflow ports are defined in the support structure at a location that is spaced from the one or more sidewall portions of the reservoir in a direction perpendicular to the axis of assembly.

* * * * *